US009487901B2

(12) United States Patent
Kim et al.

(10) Patent No.: US 9,487,901 B2
(45) Date of Patent: Nov. 8, 2016

(54) WASHING MACHINE

(71) Applicant: SAMSUNG ELECTRONICS CO., LTD., Suwon-si, Gyeonggi-do (KR)

(72) Inventors: Doo Pil Kim, Suwon-si (KR); Bong Wha Kwak, Hwaseong-si (KR); Ji Sung Kim, Seongnam-si (KR); In Cheol Jang, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/287,620

(22) Filed: May 27, 2014

(65) Prior Publication Data

US 2015/0008807 A1 Jan. 8, 2015

(30) Foreign Application Priority Data

Jul. 8, 2013 (KR) ..... 10-2013-0079839

(51) Int. Cl.

| | |
|---|---|
| ***A47B 77/06*** | (2006.01) |
| ***A47K 1/04*** | (2006.01) |
| ***A47L 19/02*** | (2006.01) |
| ***E03C 1/18*** | (2006.01) |
| ***D06F 37/28*** | (2006.01) |
| ***D06F 39/14*** | (2006.01) |
| *F25D 23/04* | (2006.01) |
| *D06F 58/04* | (2006.01) |

(52) U.S. Cl.

CPC ..... *D06F 37/28* (2013.01); *D06F 39/14* (2013.01); *D06F 58/04* (2013.01); *F25D 23/04* (2013.01)

(58) Field of Classification Search

CPC ..... D06F 37/28; D06F 39/14; D06F 58/04; D06F 39/005; F25D 23/04; F25D 23/025

See application file for complete search history.

(56) References Cited

U.S. PATENT DOCUMENTS

| | | | | |
|---|---|---|---|---|
| 3,086,830 | A * | 4/1963 | Malia | 312/200 |
| 2003/0046964 | A1* | 3/2003 | Bollmann | 68/139 |
| 2004/0244435 | A1* | 12/2004 | Kim | 68/12.26 |
| 2010/0281925 | A1* | 11/2010 | Gokceimam et al. | 68/19 |
| 2011/0025178 | A1* | 2/2011 | Schone | 312/228 |
| 2011/0160400 | A1* | 6/2011 | Lee et al. | 525/64 |
| 2012/0036900 | A1* | 2/2012 | Hong et al. | 68/139 |
| 2012/0049703 | A1* | 3/2012 | Fang et al. | 312/228 |

FOREIGN PATENT DOCUMENTS

| | | | |
|---|---|---|---|
| DE | 10144767 | C1 | 11/2002 |
| DE | 102011078920 | A1 | 1/2013 |

(Continued)

OTHER PUBLICATIONS

Extended European Search Report dated Nov. 25, 2014 in corresponding European Patent Application No. 14171662.1.

*Primary Examiner* — Andrew Roersma
*Assistant Examiner* — Andres Gallego
(74) *Attorney, Agent, or Firm* — Staas & Halsey LLP

(57) ABSTRACT

A washing machine in which a touch panel is placed at a door so that an exterior of the washing machine can be improved, the washing machine including: a body in which an opening is formed; and a door disposed to open and close the opening, wherein the door includes: a first door member that constitutes a front side of the door; and a second door member that is combined with the first door member and constitutes a rear side of the door, and wherein the first door member and the second door member are combined with each other so that the first door member is capable of being rotated relative to the second door member.

16 Claims, 8 Drawing Sheets

(56) References Cited

FOREIGN PATENT DOCUMENTS

| | | | | |
|---|---|---|---|---|
| DE | WO 2013007507 A2 * | 1/2013 | ..... | D06F 39/14 |
| DE | EP 2738299 A1 * | 6/2014 | ..... | D06F 39/14 |
| EP | 1281804 A1 | 2/2003 | | |
| EP | 2098627 A1 | 9/2009 | | |
| EP | 2402499 A1 | 1/2012 | | |
| JP | 2006-247100 | 9/2006 | | |
| KR | 10-2006-0100682 | 9/2006 | | |

* cited by examiner

WASHING MACHINE

CROSS-REFERENCE TO RELATED APPLICATIONS

This application claims the benefit of Korean Patent Application No. 10-2013-0079839, filed on Jul. 8, 2013 in the Korean Intellectual Property Office, the disclosure of which is incorporated herein by reference.

BACKGROUND

1. Field

Embodiments of the present disclosure relate to a washing machine in which a door assembling structure is improved so that marketability can be improved.

2. Description of the Related Art

In general, a washing machine is a machine that washes laundry by rotating a spin basket having a cylindrical shape in which laundry and washing water are accommodated. The type of the washing machine is classified into a drum washing machine, whereby laundry is washed when the spin basket, which is horizontally disposed, is rotated in a forward/backward direction with respect to a horizontal axis, and laundry is upwardly pulled along an inner circumferential surface of the spin basket and drops, and a vertical axis washing machine, whereby a spin basket, including a pulsator which is vertically disposed, is rotated in a forward/backward direction with respect to a vertical axis, and laundry is washed using a water current generated by the pulsator.

The drum washing machine includes a housing that constitutes an exterior of the drum washing machine, a drum that is disposed at an inner side of the housing and rotated due to a rotational force of a motor, a tub that is installed between the drum and the housing and that accommodates washing water, a laundry port through which laundry can be put into a front part of the housing, and a door that is provided to selectively open/close the laundry port.

The door of the drum washing machine includes a glass holder that constitutes a rear side of the door, a door glass that is installed at the glass holder and formed of a transparent material, and a door cover that is coupled to the glass holder and constitutes a front side of the door. A plurality of coupling holes into which a screw is inserted, are formed in a circumferential direction of the glass holder, and a coupling boss in which holes corresponding to the plurality of coupling holes are formed, is formed in the door cover. The screw is inserted into the coupling holes formed in the glass holder and is fixed to the coupling boss formed in the door cover such that the door can be assembled.

However, when the door is assembled using the screw, the coupling holes and the coupling boss for assembling should be formed in the glass holder and the door cover, respectively. Thus, a process of manufacturing the washing machine is complicated, and a worker should manually fasten the screw such that productivity is lowered.

Also, when the glass holder and the door cover are assembled using a hook, disassembling of the product is inevitable, and the whole door must be replaced when providing after-sales service (A/S).

SUMMARY

Therefore, it is an aspect of the present disclosure to provide a washing machine in which a door assembling structure is improved so that marketability and productivity can be improved.

It is another aspect of the present disclosure to provide a washing machine in which a door assembling method is changed into a rotation type coupling method so that after-sales service (A/S) can be easily provided.

Additional aspects of the disclosure will be set forth in part in the description which follows and, in part, will be apparent from the description, or may be learned by practice of the disclosure.

In accordance with an aspect of the present disclosure, a washing machine includes a body in which an opening is formed; and a door disposed to open and close the opening, wherein the door includes a first door member that constitutes a front side of the door; and a second door member that is combined with the first door member and constitutes a rear side of the door, and wherein the first door member and the second door member are combined with each other so that the first door member is capable of being rotated relative to the second door member.

The first door member may include at least one fastening protrusion formed at a rear side of the first door member in a circumferential direction of the first door member, the second door member may include at least one fastening hole formed to correspond to the at least one fastening protrusion, and the at least one fastening protrusion may be rotated and may be inserted into and fixed to the at least one fastening hole.

The second door member may include a frame coupled to the first door member; and a door glass coupled to the frame.

The at least one fastening hole may be formed in the frame.

The at least one fastening protrusion may include a guide part having an inclined surface formed therein.

The first door member may be a disc having a front side formed as a curved surface.

The at least one fastening protrusion may include a rotation prevention stopper that limits rotation of the first door member.

The washing machine may further include a fixing part for fixing the first door member and the second door member, wherein the fixing part includes a fixing protrusion formed at a rear side of the first door member; and a fixing hole formed in the second door member so as to correspond to the fixing protrusion.

The door may further include a latch member that is disposed at the second door member so as to lock the door at the body or to release locking of the door and a latch member installation part formed to install the latch member, and the fixing hole may be disposed in the latch member installation part.

The first door member may be formed of an acrylic material, and the door glass may be formed of a glass material.

The frame may include: a first frame; and a second frame disposed at an outer side of the first frame, and an edge of the door glass may be inserted between the first frame and the second frame so that the first frame and the second frame are assembled with each other.

In accordance with another aspect of the present disclosure, a washing machine includes a body, which constitutes an exterior of the washing machine and in which an opening is formed; and a door disposed to open and close the opening, wherein the door may include a first door member that constitutes a front side of the door; and a second door member that is connected to the first door member and constitutes a rear side of the door, and wherein the first door member may include at least one fastening protrusion formed at a rear side of the first door member to be spaced apart from each other by a predetermined gap in a circumferential direction of the first door member, the second door member may include at least one fastening hole formed at a front side of the second door member to correspond to the at least one fastening protrusion, and the first door member may be rotated so that the at least one fastening protrusion is inserted into and fixed to the at least one fastening hole.

The second door member may include a frame coupled to the first door member; and a door glass coupled to the frame.

The at least one fastening hole may be formed in the frame.

The frame may include a first frame; and a second frame disposed at an outer side of the first frame, and an edge of the door glass may be inserted between the first frame and the second frame so that the first frame and the second frame are assembled with each other.

The washing machine may further include a fixing part for fixing the first door member and the second door member, wherein the fixing part includes a fixing protrusion formed at a rear side of the first door member; and a fixing hole formed in the second door member so as to correspond to the fixing protrusion.

The at least one fastening protrusion may include a guide part having an inclined surface formed therein.

The door may further include a latch member that is disposed at the second door member so as to lock the door at the body or to release locking of the door and a latch member installation part formed to install the latch member, and the fixing hole may be disposed in the latch member installation part.

The first door member may be formed of an acrylic material, and the door glass may be formed of a glass material.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
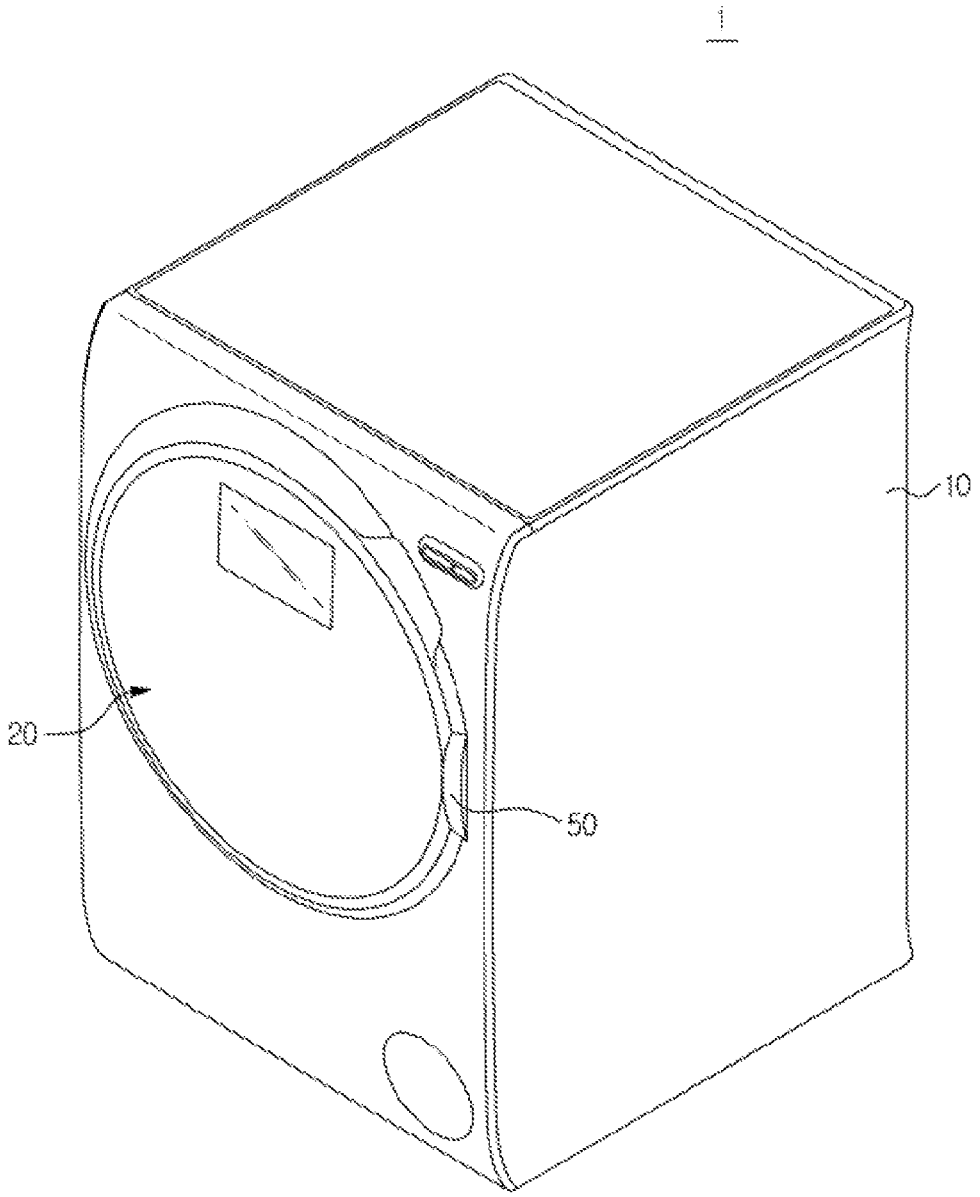
FIG. 1 is a perspective view schematically illustrating a drum washing machine in accordance with an embodiment of the present disclosure.

Reference will now be made in detail to the embodiments of the present disclosure, examples of which are illustrated in the accompanying drawings, wherein like reference numerals refer to like elements throughout.

Figure 2:
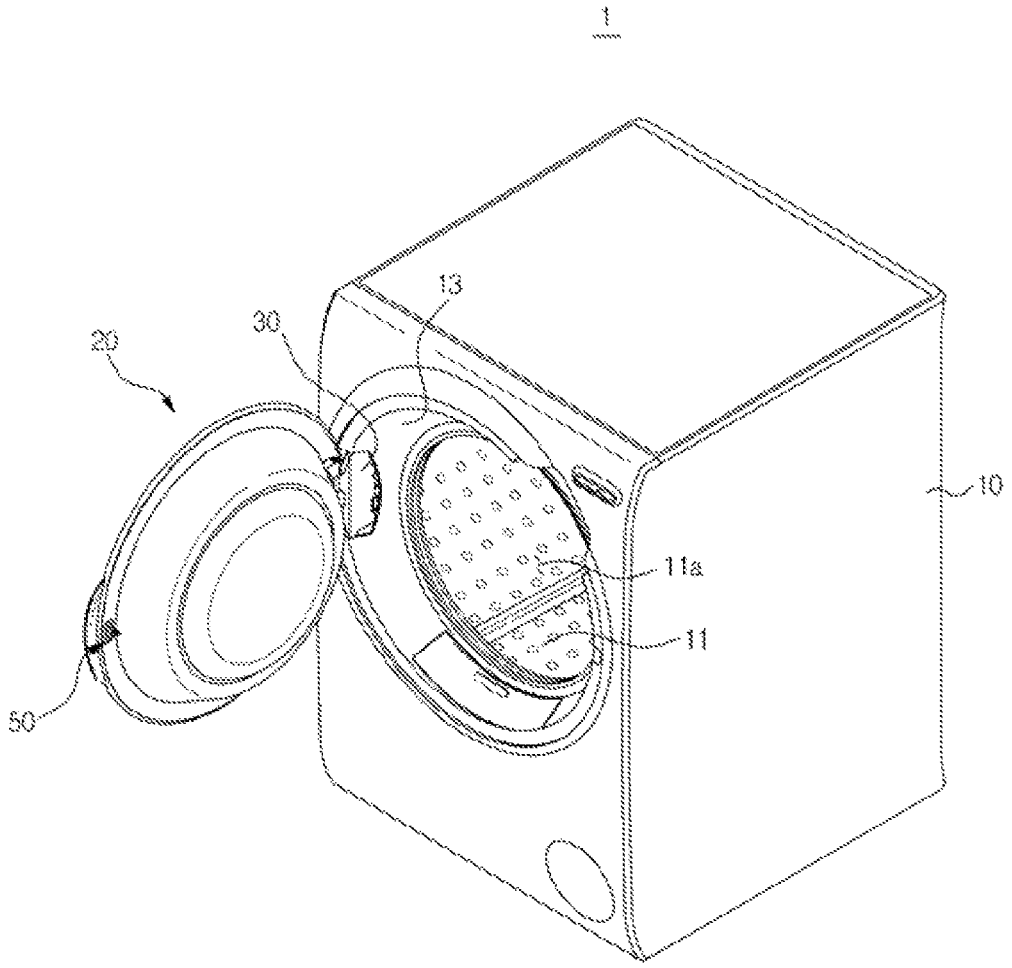
FIG. 2 is a perspective view schematically illustrating the drum washing machine illustrated in FIG. 1 in which a door is installed.

FIG. 1 is a perspective view schematically illustrating a drum washing machine in accordance with an embodiment of the present disclosure, and FIG. 2 is a perspective view schematically illustrating a door of the drum washing machine illustrated in FIG. 1.

As illustrated in FIGS. 1 and 2, a drum washing machine 1 includes a body 10 that constitutes an exterior of the drum washing machine 1, a tub (not shown) which is installed inside the body 10 and in which washing water is stored, and a cylindrical drum 11 which is rotatably installed inside the tub (not shown) and which has a wall surface in which a plurality of dehydration holes are formed.

A driving unit (not shown) may be provided in the rear of the drum 11. The driving unit (not shown) as an element for rotating the drum 11 may be provided to transfer a driving force generated by a motor to a washing shaft via a belt so that the drum 11 can be rotated.

The tub is provided to be elastically supported from the body 10 by an upper spring (not shown) and a lower damper (not shown). That is, when vibration generated when the drum 11 is rotated is transferred to the tub and the body 10, vibration energy may be absorbed between the tub and the body 10 so that vibration transferred to the body 10 can be attenuated.

Also, apertures through which laundry can be put into or taken out from the front of the body 10, are formed in the tub and the drum 11, and an opening 11*a* is formed in a front side of the body 10 so as to correspond to or to be larger than the apertures of the tub and the drum 11.

A door 20 is mounted on the opening 11*a* of the body 10 so as to open/close the apertures of the tub and the drum 11.

A door bracket 13 for installing the door 20 is disposed in the opening 11*a* of the body 10. The door bracket 13 constitutes a surface on which the door 20 can be installed and supported by the door bracket 13. The door bracket 13 may be slantedly formed in a direction of the apertures of the tub and the drum 11 from a front side of the body 10.

The door 20 may be rotatably installed by a hinge member 30 disposed at one side of the door bracket 13 disposed on the body 10. The door 20 is rotated by the hinge member 30 and is installed to selectively open and close the opening 11*a* of the body 10.

A latch member 50 may be disposed at the other side of the door 20 so as to lock the door 20 at the door bracket 13 of the body 10 or to release locking of the door 20.

Figure 3:
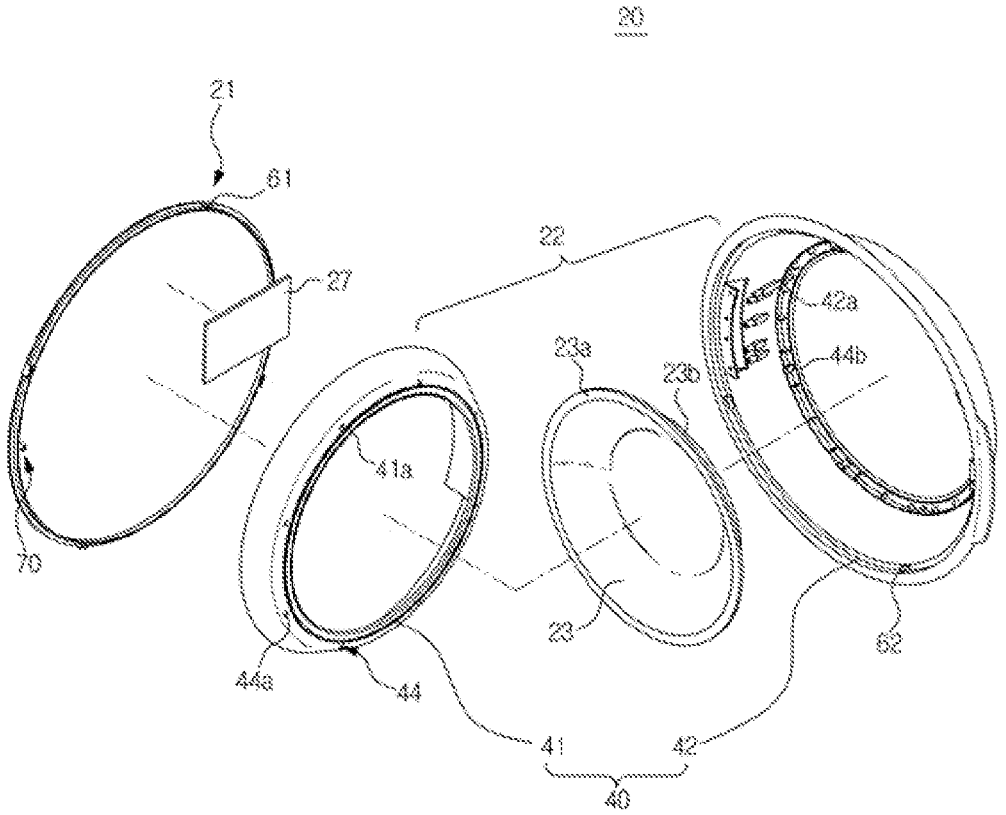
FIG. 3 is an exploded perspective view schematically illustrating the door of the drum washing machine of FIG. 2.
Figure 4:
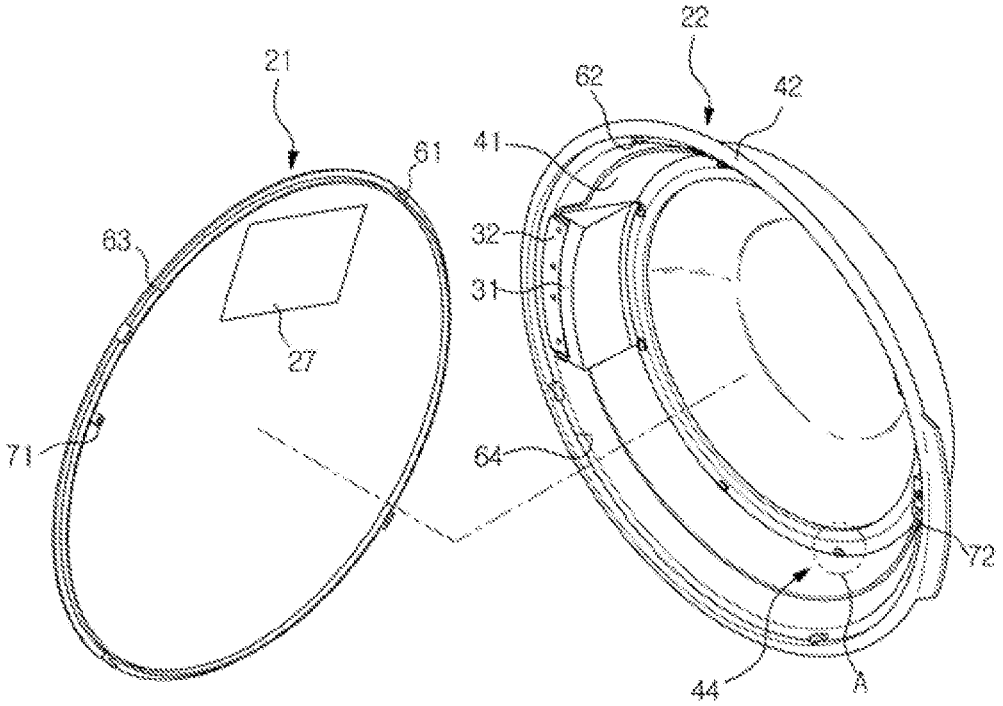
FIG. 4 schematically illustrates a first door member and a second door member of the door of FIG. 3.
Figure 5:
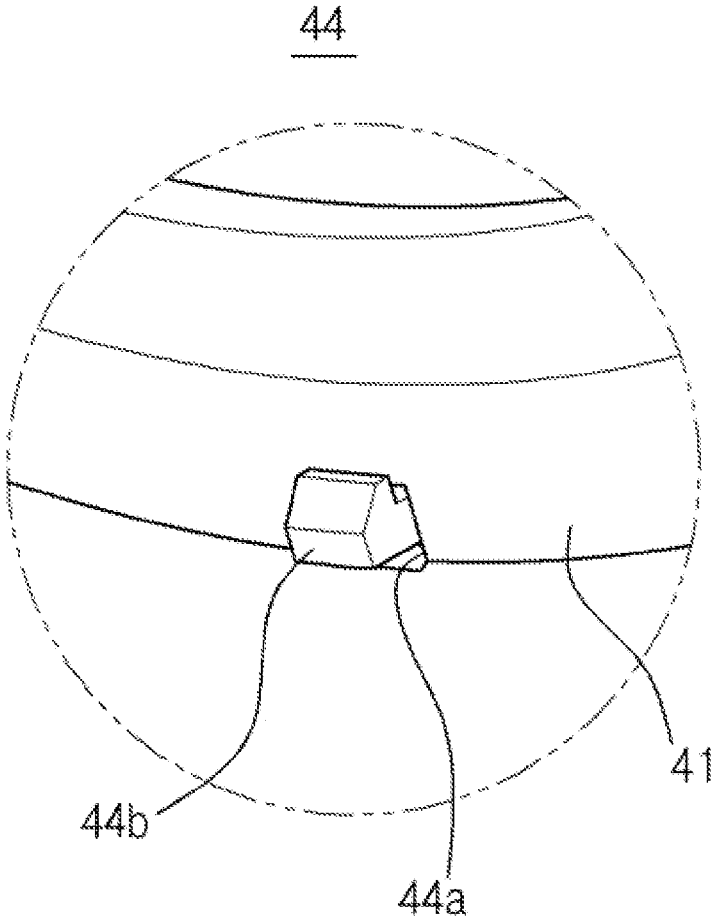
FIG. 5 is an enlarged view of portion A of FIG. 4.

FIG. 3 is an exploded perspective view schematically illustrating the door of the drum washing machine of FIG. 2, and FIG. 4 schematically illustrates a first door member and a second door member of the door of FIG. 3, and FIG. 5 is an enlarged view of portion A of FIG. 4.

As illustrated in FIGS. 3 through 5, the door 20 may include a first door member 21 that constitutes a front side of the door 20 and a second door member 22 that constitutes a rear side of the door 20.

The first door member 21 may have a curved surface disc shape having curvature in which a front side of the first door member 21 protrudes in a forward direction.

Various designs may be inserted into the first door member 21 so as to be aesthetically appealing of a product. The first door member 21 may be formed of a transparent material so that a user can watch an inside of the drum washing machine 1 through the door 20. For example, the first door member 21 may be formed of a transparent polymethyl methacrylate (PMMA) material.

Also, a touch panel unit 27 including a touch panel (not shown) on which an input signal transmitted through a user's touch operation is sensed and a display panel (not shown) on which the input signal transmitted to the touch panel is displayed, may be disposed at a rear side of the first door member 21.

The touch panel unit 27 may be adhered to and fixed to the rear side of the first door member 21.

The second door member 22 may be disposed in the rear of the first door member 21 and may constitute a rear side of the door 20.

The second door member 22 includes a door glass 23 and a frame 40 that connects a space between the first door member 21 and the door glass 23. The door glass 23 may be formed of a transparent material so that the user can watch an inside of the drum 11 in a state in which the door 20 is closed, and for example, the door glass 23 may be formed of glass.

The front of the door glass 23 is open so that a predetermined space is formed in an inner side of the door glass 23. A wing part 23*a* that fixes and supports the door glass 23 may be formed at a circumference of the open front of the door glass 23, and a body part 23*b* that constitutes an exterior of the door glass 23 may be formed in a closed rear of the door glass 23.

The frame 40 includes a first frame 41 and a second frame 42 that is disposed to surround an outer side of the first frame 41 and coupled to the first frame 41.

Door glass supports 41*a* and 42*a* may be formed at central ends of the first frame 41 and the second frame 42, and the wing part 23*a* of the door glass 23 may be inserted into and coupled to the door glass supports 41*a* and 42*a*.

The first frame 41 and the second frame 42 may be coupled to each other by a hook part 44. The hook part 44 may include a hook protrusion 44*b* and a hook groove 44*a*. The hook groove 44*a* may be formed in a rear side of the first frame 41 that protrudes, and the hook protrusion 44*b* may be formed at an inner side of the second frame 42 so as to correspond to the hook groove 44*a* and to be coupled to the hook groove 44*a*.

Also, hinge member installation parts 31 and 32 in which the hinge member 30 for coupling the door 20 to the door bracket 13 of the body 10 is to be installed, may be disposed at one side of the first frame 41 and at one side of the second frame 42.

In the present embodiment, the first frame 41 and the second frame 42 are hook-coupled to each other, for example. However, embodiments of the present disclosure are not limited thereto. For example, the first frame 41 and the second frame 42 may be coupled to each other by a screw.

Also, in the present embodiment, the hook groove 44*a* is formed in the rear side of the first frame 41, and the hook protrusion 44*b* is formed at the inner side of the second frame 42. However, the hook protrusion 44*b* may be formed at the first frame 41, and the hook groove 44*a* may be formed in the second frame 42.

The second door member 22 including the frame 40 that is assembled by the first frame 41 and the second frame 42 and the door glass 23, may be disposed to be assembled with and separated from the first door member 21.

Figure 6:
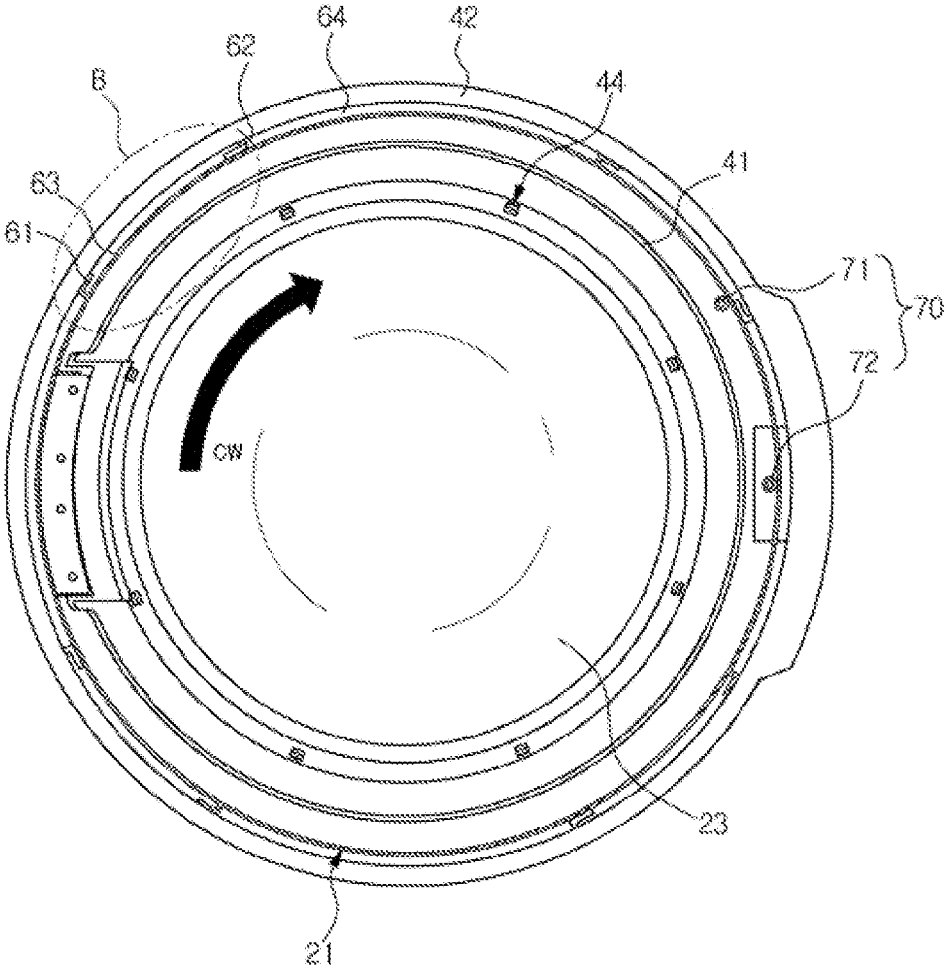
FIG. 6 schematically illustrates rotation assembling of the first door member and the second door member of the door of FIG. 3.
Figure 7:
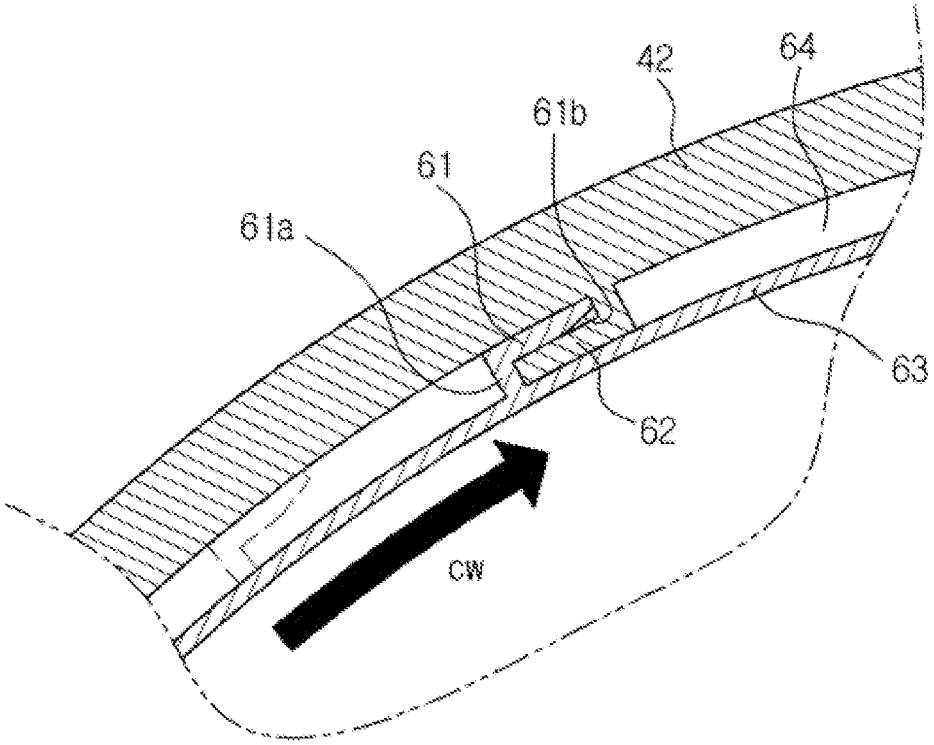
FIG. 7 is an enlarged view of portion B of FIG. 6.
Figure 8:
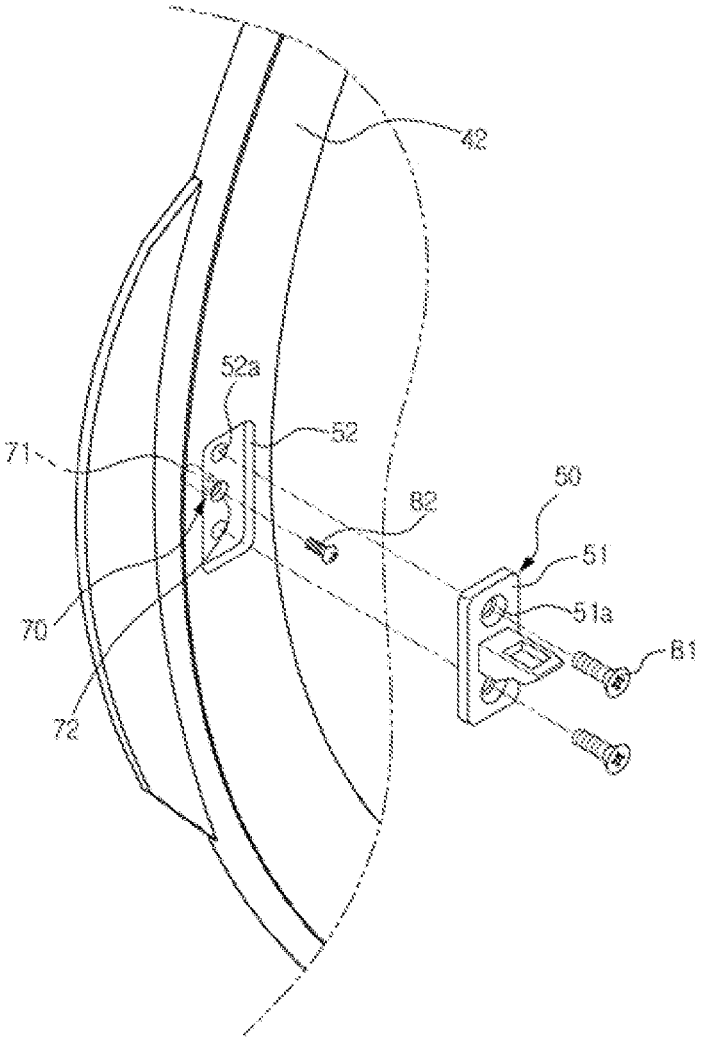
FIG. 8 schematically illustrates a fixing part of the first door member and the second door member of the door of FIG. 3.

FIG. 6 schematically illustrates rotation assembling of the first door member and the second door member of the door of FIG. 3, FIG. 7 is an enlarged view of portion B of FIG. 6, and FIG. 8 schematically illustrates a fixing portion of the first door member and the second door member of the door of FIG. 3.

As illustrated in FIGS. 6 and 7, in order to assemble the first door member 21 and the second door member 22 that constitute the door 20, at least one or more fastening protrusions 61 that are disposed to be spaced apart from each other by a predetermined gap in a circumferential direction of the first door member 21, may be formed at an outer edge of the rear side of the first door member 21.

In the present embodiment, the fastening protrusions 61 are formed at positions corresponding to angles of 0°, 90°, 180°, and 270°, respectively, in vertical and horizontal directions of the first door member 21. However, embodiments of the present disclosure are not limited thereto. For example, at least two or more fastening protrusions 61 may be formed and disposed in the circumferential direction of the first door member 21.

Each of the fastening protrusions 61 may include a rotation prevention stopper 61*a* that is formed in a "¬"-shape along a rotation direction of the first door member 21 and that limits rotation of the first door member 21.

In this case, the rotation prevention stopper 61*a* may be vertically formed at one end of each of the fastening protrusions 61.

At least one or more fastening holes 62 corresponding to the fastening protrusions 61 may be formed in an inner edge of a front side of the second frame 42.

The fastening holes 62 may be disposed in the front side of the second frame 42 to be spaced apart from each other by a predetermined gap in a circumferential direction of the second frame 42 and may be formed in a "ㄴ"-shape along the rotation direction of the first door member 21.

In this case, a circular guide protrusion 63 may be formed at an edge of a rear side of the first door member 21 so as to guide rotation of the first door member 21, and a guide groove 64 corresponding to the guide protrusion 63 may be formed in an inner edge of the second frame 42.

The fastening protrusions 61 may be formed to protrude in a direction of an outer side of the guide protrusion 63 of the first door member 21, and the fastening holes 62 may be disposed in the front of the guide groove 64 of the second frame 42.

A guide part 61*b* is disposed at an end of each fastening protrusion 61 so as to be inclined in the rotation direction of the first door member 21.

The guide part 61*b* of the fastening protrusion 61 is disposed to guide movement of the fastening protrusion 61 so that coupling of the fastening protrusions 61 and the fastening holes 62 can be smoothly performed.

Thus, the first door member 21 is assembled with the second door member 22 by allowing the guide protrusion 63 of the first door member 21 and the guide groove 64 of the second frame 42 to correspond to each other, and the first door member 21 is rotated clockwise cw so that the fastening protrusions 61 of the first door member 21 can be inserted into and assembled with the fastening holes 62 of the second frame 42.

In this case, the first door member 21 may be rotated and assembled until the fastening hole 62 is hung in the rotation prevention stopper 61*a* of the fastening protrusion 61 and movement of the second frame 42 is stopped.

In the present embodiment, the first door member 21 is rotated clockwise cw. However, embodiments of the present disclosure are not limited thereto. For example, the first door member 21 may be rotated counterclockwise and may be fastened. In this case, a direction in which the fastening protrusions 61 of the first door member 21 are to be fastened to the fastening holes 62 of the second frame 42 corresponding to the fastening protrusions 61, may be counterclockwise that is the rotation direction of the first door member 21.

In this way, the first door member 21 and the second door member 22 that constitute the door 20, can be easily assembled with and separated from each other so that after-sales service (A/S) of associated parts, such as the door 20 and the touch panel unit 27 disposed inside the door 20, can be easily provided.

A fixing part 70 may be disposed so as to prevent the first door member 21 of the door 20 from being separated from the second door member 22.

As illustrated in FIG. 8, the door 20 having one side coupled to the door bracket 13 of the body 10 by the hinge member 30 includes the latch member 50 that is disposed at the other side of the door 20 and locks the door 20 at the body 10 or releases locking of the door 20.

The latch member 50 may include a latch bracket 51 and assembling holes 51*a* formed in the latch bracket 51. The latch bracket 51 is installed at a rear side of the second frame 42 of the second door member 22 and is provided to lock the door 20 at the body 10 or to release locking of the door 20 due to rotation of the door 20.

To this end, a latch member installation part 52 may be disposed at a rear side of the second frame 42. The latch member installation part 52 may be formed to be recessed inwardly from the rear side of the second frame 42 and may be formed to correspond to the size of the latch bracket 51.

Assembling grooves 52*a* in which the latch member installation part 52 is to be assembled with the latch bracket 51, are formed in the latch member installation part 52.

The fixing part 70 disposed to fix the first door member 21 to the second door member 22 may include a fixing protrusion 71 that protrudes from the rear side of the first door member 21 and a fixing hole 72 disposed in the latch member installation part 52 so as to correspond to the fixing protrusion 71. The fixing hole 72 may be formed in an inner side of the latch member installation part 52.

Thus, the first door member 21 is rotated so as to be temporarily assembled with the second frame 42 and the second door member 22, and a bolt B1 is assembled with and fixed to the fixing protrusion 71 of the first door member 21 through the fixing hole 72 of the second door member 22.

The latch bracket 51 is placed at the latch member installation part 52, and a bolt B2 is assembled with and fixed to the latch bracket 51 so as to pass through the assembling holes 51*a* and the assembling grooves 52*a* of the latch bracket 51.

In this way, the fixing part 70 of the first door member 21 and the second door member 22 is not exposed to the outside due to the latch bracket 51 assembled with the latch member installation part 52 so that the exterior of the door 20 can be improved.

Also, durability of the door 20 can be improved by the fixing part 70 that fixes the first door member 21 and the second door member 22.

As described above, in accordance with the one or more of the embodiments of the present disclosure, a door assembling structure is improved so that marketability and productivity can be improved.

In addition, a door assembling method is changed into a rotation type coupling method so that after-sales service (A/S) can be easily provided and an A/S time can be reduced.

Although a few embodiments of the present disclosure have been shown and described, it would be appreciated by those skilled in the art that changes may be made in these embodiments without departing from the principles and spirit of the invention, the scope of which is defined in the claims and their equivalents. In the present embodiment, a rotation coupling structure of a door is applied to a drum washing machine; however, the rotation coupling structure of the door can also be applied to electronic products, such as a washing machine and a drying machine, as well as the drum washing machine.

What is claimed is:

1. A washing machine comprising:

a body in which an opening is formed; and a door disposed to open and close the opening, wherein the door comprises a first door member that constitutes a front side of the door, the first door member comprising a guide protrusion defining a circumferential ring arranged to protrude rearwardly at an edge of a rear side of the first door member, and at least one fastening protrusion formed in a circumferential direction of the first door member and arranged to protrude from an outer side of the guide protrusion, the at least one fastening protrusion being configured to protrude in a rotation direction of the first door member, the at least one fastening protrusion comprising a guide part having an inclined surface formed therein and a rotation prevention stopper vertically formed at one end thereof to limit rotation of the first door member; and a second door member that is combined with the first door member and constitutes a rear side of the door, the second door member comprising a guide groove corresponding to the guide protrusion, the guide protrusion being arranged to be received in the guide groove and the guide protrusion is arranged to guide rotation of the first door member, and at least one fastening hole formed to correspond to the at least one fastening protrusion, wherein the first door member and the second door member are combined with each other so that the first door member is capable of being rotated relative to the second door member, and the at least one fastening protrusion is capable of being rotated and inserted into and fixed to the at least one fastening hole.

2. The washing machine according to claim 1, wherein the second door member comprises:

a frame coupled to the first door member; and a door glass coupled to the frame.

3. The washing machine according to claim 2, wherein the at least one fastening hole is formed in the frame.

4. The washing machine according to claim 2, wherein the first door member is formed of an acrylic material, and the door glass is formed of a glass material.

5. The washing machine according to claim 2, wherein the frame comprises:

a first frame; and a second frame disposed at an outer side of the first frame, and an edge of the door glass is inserted between the first frame and the second frame so that the first frame and the second frame are assembled with each other.

6. The washing machine according to claim 1, further comprising a fixing part for fixing the first door member and the second door member, wherein the fixing part comprises a fixing protrusion formed at the rear side of the first door member; and a fixing hole formed in the second door member so as to correspond to the fixing protrusion.

7. The washing machine according to claim 6, wherein the door further comprises:

a latch member that is disposed at the second door member so as to lock the door at the body or to release locking of the door; and a latch member installation part formed to install the latch member, and the fixing hole is disposed in the latch member installation part.

8. The washing machine according to claim 1, wherein the first door member is a disc having a front side formed as a curved surface.

9. A washing machine comprising:

a body, which constitutes an exterior of the washing machine and in which an opening is formed; and a door disposed to open and close the opening, wherein the door comprises a first door member that constitutes a front side of the door; and a second door member that is connected to the first door member and constitutes a rear side of the door, and wherein the first door member comprises at least two fastening protrusions formed at an edge of a rear side of the first door member, the at least two fastening protrusions being spaced apart from each other by a predetermined gap in a circumferential direction of the first door member, each of the at least two fastening protrusions being configured to protrude in a rotation direction of the first door member, and the at least two fastening protrusions being formed in a circumferential direction of the first door member and protruding from an outer side of a guide protrusion, the guide protrusion defining a circumferential ring arranged to protrude rearwardly at the edge of the rear side of the first door member, the at least two fastening protrusions comprising a guide part having an inclined surface formed therein, the second door member comprises at least two fastening holes formed at a front side of the second door member to correspond to the at least two fastening protrusions, and a guide groove corresponding to the guide protrusion, the guide protrusion being arranged to be received in the guide groove, and the guide protrusion being arranged to guide rotation of the first door member, and the first door member is configured to be rotated so that the at least two fastening protrusions are guided by the guide part and configured to be rotatively inserted into and fixed to the at least two fastening holes.

10. The washing machine according to claim 9, wherein the second door member comprises:

a frame coupled to the first door member; and a door glass coupled to the frame.

11. The washing machine according to claim 10, wherein the at least two fastening holes are formed in the frame.

12. The washing machine according to claim 10, wherein the frame comprises:

a first frame; and a second frame disposed at an outer side of the first frame, and an edge of the door glass is inserted between the first frame and the second frame so that the first frame and the second frame are assembled with each other.

13. The washing machine according to claim 10, wherein the first door member is formed of an acrylic material, and the door glass is formed of a glass material.

14. The washing machine according to claim 9, further comprising a fixing part for fixing the first door member and the second door member, wherein the fixing part comprises a fixing protrusion formed at the rear side of the first door member; and a fixing hole formed in the second door member so as to correspond to the fixing protrusion.

15. The washing machine according to claim 14, wherein the door further comprises:

a latch member that is disposed at the second door member so as to lock the door at the body or to release locking of the door; and a latch member installation part formed to install the latch member, and the fixing hole is disposed in the latch member installation part.

16. The washing machine according to claim 9, further comprising a touch panel unit configured to receive an input signal transmitted through a user's touch operation, the touch panel unit being disposed at the rear side of the first door member.

* * * * *